US008836583B2

(12) United States Patent
Maruyama et al.

(10) Patent No.: US 8,836,583 B2
(45) Date of Patent: Sep. 16, 2014

(54) REFLECTARRAY

(75) Inventors: Tamami Maruyama, Yokohama (JP); Tomoyuki Ohya, Yokohama (JP); Tatsuo Furuno, Yokosuka (JP); Kunio Sawaya, Miyagi (JP); Qiang Chen, Miyagi (JP); Jianfeng Li, Miyagi (JP); Shiwei Qu, Miyagi (JP); Qiaowei Yuan, Miyagi (JP)

(73) Assignees: NTT DoCoMo, Inc., Tokyo (JP); Tohoku University, Sendai-shi (JP)

( * ) Notice: Subject to any disclaimer, the term of this patent is extended or adjusted under 35 U.S.C. 154(b) by 237 days.

(21) Appl. No.: 13/216,451

(22) Filed: Aug. 24, 2011

(65) Prior Publication Data

US 2012/0050127 A1 Mar. 1, 2012

(30) Foreign Application Priority Data

Aug. 27, 2010 (JP) ..... 2010-191568

(51) Int. Cl.
*H01Q 1/38* (2006.01)
*H01Q 15/00* (2006.01)

(52) U.S. Cl.
CPC ..... *H01Q 15/002* (2013.01); *H01Q 1/38* (2013.01)
USPC ..... 343/700 MS

(58) Field of Classification Search
USPC ..... 343/700 MS, 795
See application file for complete search history.

(56) References Cited

U.S. PATENT DOCUMENTS

| | | | | |
|---|---|---|---|---|
| 6,876,336 | B2 * | 4/2005 | Croswell et al. | 343/795 |
| 7,173,577 | B2 * | 2/2007 | Brown et al. | 343/909 |
| 7,330,161 | B2 * | 2/2008 | Matsugatani et al. | 343/909 |
| 2003/0142036 | A1 | 7/2003 | Wilhelm et al. | |

FOREIGN PATENT DOCUMENTS

| | | |
|---|---|---|
| JP | 60-251707 | 12/1985 |
| JP | 07-154133 | 6/1995 |
| JP | 2007-5614 | 1/2007 |
| JP | 2010-93811 | 4/2010 |
| JP | 2011-19021 | 1/2011 |

OTHER PUBLICATIONS

Daniel Frederic Sievenpiper, "High-Impedance Electromagnetic Surfaces", University of California Los Angeles, 1999, 161 pages.
Kihun Chang, et al., "Artificial Surface Having Frequency Dependent Reflection Angle", ISAP, 2008, 4 pages.
Long Li, et al., "Microstrip Reflectarray Using Crossed-Dipole with Frequency Selective Surface of Loops", ISAP, 2008, 4 pages.
Tamami Maruyama, et al., "Experiment and Analysis of Reflect Beam Direction Control using a Reflector having Periodic Tapered Mushroom-like Structure", ISAP, 2008, 4 pages.
John Huang, et al., "Reflectarray Antennas", Chapter 3, Antenna Analysis Techniques, IEEE, 2008, 2 pages.

(Continued)

*Primary Examiner* — Tan Ho
(74) *Attorney, Agent, or Firm* — Oblon, Spivak, McClelland, Maier & Neustadt, L.L.P.

(57) ABSTRACT

A reflectarray, including: a substrate; and a plurality of patches formed on each of areas into which a principal surface of the substrate is divided, wherein the plurality of patches are formed by including a gap.

6 Claims, 22 Drawing Sheets

(56) References Cited

OTHER PUBLICATIONS

Office Action issued Jul. 31, 2012 in Japanese Patent Application No. 2010-191568 (with English translation).

Extended European Search Report issued Nov. 10, 2011, in Patent Application No. 11179107.5.

D M Pozar, "Wideband reflectarrays using artificial impedance surfaces", Electronics Letters, vol. 43, No. 3, XP006028166, Feb. 1, 2007, pp. 148-149.

Jianfeng Li, et al., "Reflectarray Design Based on Interdigital Gap Loading Element", Wireless Information Technology and Systems, XP031782522, Aug. 28, 2010, pp. 1-4.

* cited by examiner

FIG.6

| L | $l_d$ | $w_d$ | s | t | $\varepsilon_r$ |
|---|---|---|---|---|---|
| 5.0mm | 4.0mm | 1.2mm | 0.05mm | 0.75mm | 2.5 |

FIG.7A

| L | $l_d$ | $w_d$ | s | t | $\varepsilon_r$ |
|---|---|---|---|---|---|
| 10.0mm | 8.0mm | 2.6mm | 0.2mm | 1.6mm | 2.5 |

FIG.7B

| L | $l_d$ | $w_d$ | s | t | $\varepsilon_r$ |
|---|---|---|---|---|---|
| 40.0mm | 32.0mm | 9.6mm | 0.4mm | 6.0mm | 2.5 |

FIG.14

| Column | Fingers length(mm) | Compensation phase(Deg.) |
|---|---|---|
| 1 | 0.875 | 374.124(14.124) |
| 2 | 1.295 | 249.416(−110.584) |
| 3 | 0.241 | 124.708 |
| 4 | 0.912 | 0 |
| 5 | 1.312 | −124.708 |
| 6 | 0.400 | −249.416(110.584) |
| 7 | 0.980 | −374.124(−14.124) |

FIG.17

| Column | Fingers length(mm) | Compensation phase(Deg.) |
|---|---|---|
| 1 | 7.000 | 374.124(14.124) |
| 2 | 10.360 | 249.416(−110.584) |
| 3 | 1.928 | 124.708 |
| 4 | 7.296 | 0 |
| 5 | 10.496 | −124.708 |
| 6 | 3.200 | −249.416(110.584) |
| 7 | 7.840 | −374.124(−14.124) |

FIG.19

| Column | Fingers length(mm) | Compensation phase(Deg.) |
|---|---|---|
| 1 | 3.36 | 623.540(−96.46) |
| 2 | 1.40 | 498.832(138.832) |
| 3 | 2.62 | 374.124(14.124) |
| 4 | 3.41 | 249.416(−110.584) |
| 5 | 1.63 | 124.708 |
| 6 | 2.78 | 0 |
| 7 | 3.45 | −124.708 |
| 8 | 1.78 | −249.416(110.584) |
| 9 | 2.93 | −374.124(−14.124) |
| 10 | 3.48 | −498.832(−138.832) |
| 11 | 1.90 | −623.540(96.46) |

200
204a
204b
205₅
205₆
202
206
L
A
$l_s$
$l_d$
$w_s$
$w_d$
s
t
x
y
$\varepsilon_r$

REFLECTARRAY

BACKGROUND OF THE INVENTION

1. Field of the Invention

The present invention relates to a reflectarray.

2. Description of the Related Art

In mobile communications, if there is an obstacle such as a building on a route of a radio wave, a reception level deteriorates. For addressing this problem, there is a technique in which a reflector is provided on a high place the height of which is similar to that of the building in order to transmit a reflected wave to places where a radio wave is hard to reach. If an incident angle of the radio wave in a vertical plane is relatively small when reflecting the radio wave using the reflector, it becomes difficult for the reflector to direct the radio wave to a desired direction. The reason is that, generally, the incident angle and the reflection angle of the radio wave are the same.

For addressing this problem, it can be considered to incline the reflector such that the reflector looks into the ground. Accordingly, the incident angle and the reflection angle with respect to the reflector can be increased so that an incoming wave can be directed to a desired direction. However, from the viewpoint of safety, it is not desirable to mount the reflector by inclining it toward the ground side, since the reflector is placed on the high place similar to the building that may obstruct radio waves. From this viewpoint, it is desired to realize a reflector that can direct a reflected radio wave to a desired direction even when the incident angle of the radio wave is relatively small.

As such a reflector, an application of a reflectarray is reported (for example, refer to non-patent documents 1 and 2).

The reflectarray can be designed by arranging phase shifts of reflected waves such that a beam is directed to a desired direction. As shown in FIGS. 1A and 1B, various techniques are introduced such as a method for using a stub, a method for varying sizes and the like (for example, refer to non-patent document 3).

Non-patent document 1: L. Li et al., "Microstrip reflectarray using crossed-dipole with frequency selective surface of loops," ISAP2008, TP-C05, 1645278.

Non-patent document 2: T. Maruyama, T. Furuno, and S. Uebayashi, "Experiment and analysis of reflect beam direction control using a reflector having periodic tapered mushroom-like structure," ISAP2008, MO-IS1, 1644929, p. 9.

Non-patent document 3: J. Huang and J. A. Encinar, Reflectarray antennas. Piscataway, N.J. Hoboken: IEEE Press; Wiley-Interscience, 2008.

However, according to the conventional method of using a stub shown in FIG. 1A, a loss caused by the stub and unnecessary radiation from the stub may become a problem. Also, according to the method of varying the patch dimensions as shown in FIG. 1B, there is a problem in that the size of the patch is varied for producing phase shift. Therefore, there is a problem in that patches of different sizes not only change the phase shift but also exert an influence upon radiation. In addition, in these methods, there is a problem in that a range of variation of reflection phase is less than 360 degrees.

FIG. 2 shows an example of a conventional reflectarray.

In the reflectarray 1, microstrip antennas are used as array elements 10 and a metal flat plate is used as a ground plane 20. FIG. 2 shows an example in which the array element 10 is a square. The dimensions a and b of the array element 10 are determined based on a phase shift.

In order to realize a reflectarray for directing a radio wave to a desired direction by using many elements, it is necessary to arrange elements for providing a phase (reflection phase) of a predetermined reflection coefficient. Ideally, it is desirable that the reflection phase covers a range larger than $2\pi$ radian ($2\pi$ radian=360 degrees) with respect to a predetermined range of a structure parameter such as the patch size.

However, in the case when the array element is configured by the microstrip antenna, there is a problem in that the phase of the reflection coefficient in a given frequency does not cover a wide range.

SUMMARY OF THE INVENTION

The present invention is contrived from the viewpoint of the above-mentioned problem, and an object of the present invention is to provide a reflectarray that can widen the phase range of the reflection coefficient, and that can vary the phase shift without varying the size of elements forming the reflectarray.

An aspect of the present invention provides a reflectarray, including:

a substrate; and a plurality of patches formed on each of areas into which a principal surface of the substrate is divided, wherein the plurality of patches are formed by including a gap.

According to the reflectarray, the phase range of the reflection coefficient can be widened. Also, according to the reflectarray, the phase shift can be varied without varying the size of elements forming the reflectarray, so that deterioration of radiation can be prevented.

BRIEF DESCRIPTION OF THE DRAWINGS

FIG. 6 is a diagram showing an example (24 GHz) of dimensions of an array element according to an embodiment of the present invention;

FIG. 7A is a diagram showing an example (12 GHz) of dimensions of an array element according to an embodiment of the present invention;

FIG. 7B is a diagram showing an example (3 GHz) of dimensions of an array element according to an embodiment of the present invention;

FIG. 14 is a diagram showing an example of dimensions of a reflectarray (1) according to an embodiment of the present invention;

FIG. 17 is a diagram showing an example of dimensions of a reflectarray (2) according to an embodiment of the present invention;

FIG. 19 is a diagram showing an example of dimensions of a reflectarray (3) according to an embodiment of the present invention;

DESCRIPTION OF THE PREFERRED EMBODIMENTS

Next, embodiments of the present invention are described below with reference to the drawings. In the figures for describing embodiments, the same reference symbols are attached to parts having the same function, and descriptions thereof are omitted.

Embodiments

Figure 1B:
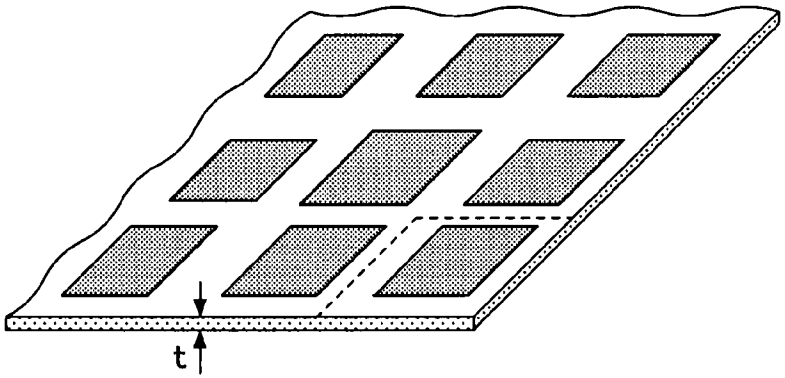
FIG.1B PRIOR ART
FIGS. 1A and 1B are diagrams for explaining problems in conventional techniques.
Figure 1A:
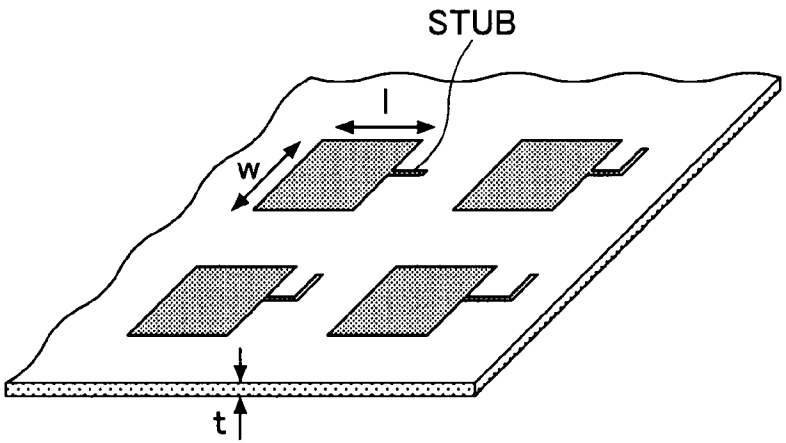
FIG.1A PRIOR ART
Figure 2:
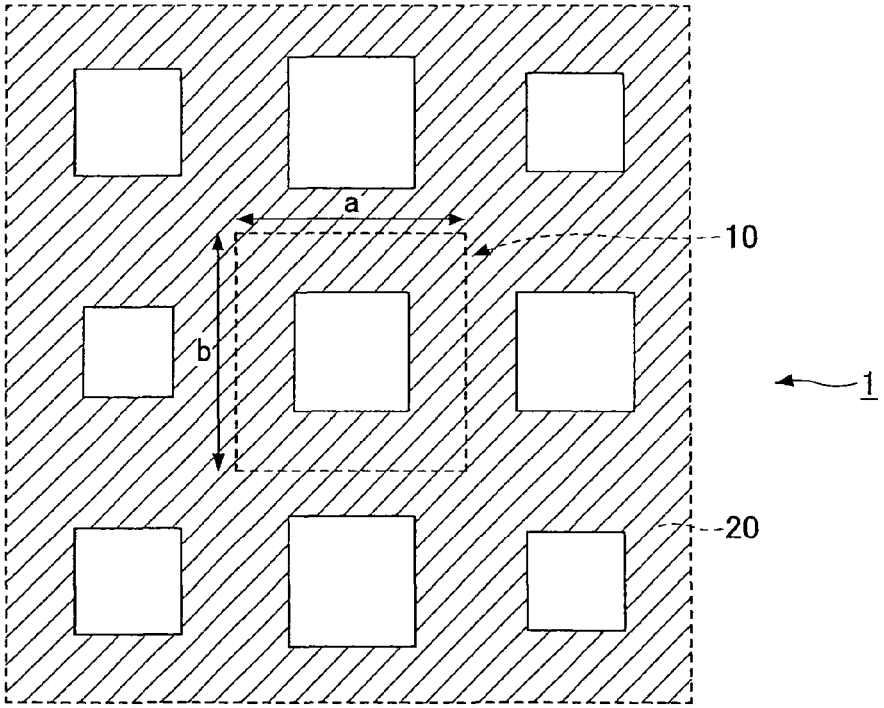
FIG.2 RELATED ART
FIG. 2 is a diagram showing an example of a conventional microstrip reflectarray.
Figure 3:
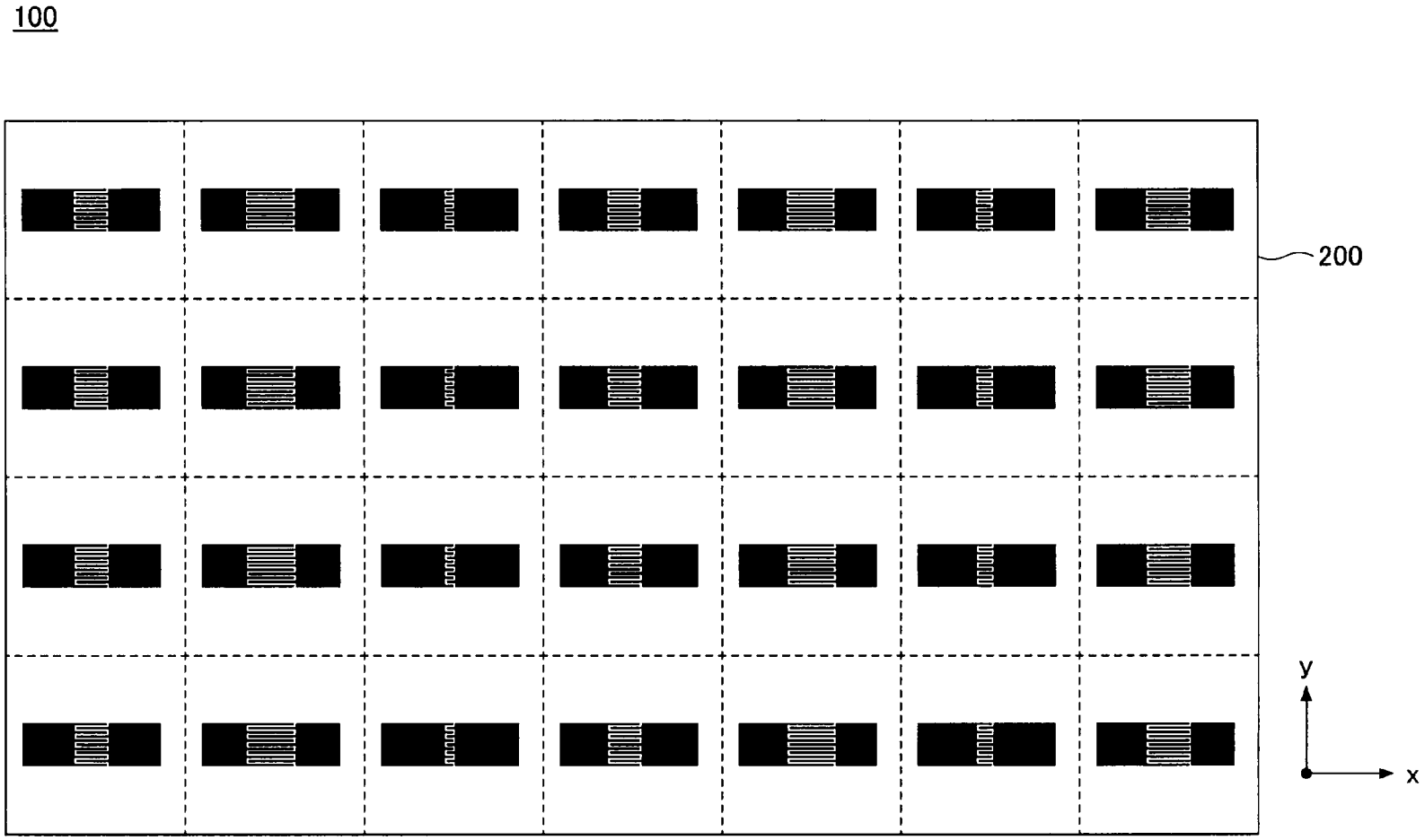
FIG. 3 is a diagram showing a reflectarray according to an embodiment of the present invention.

In the following, a first embodiment of the present invention is described with reference to FIGS. 3 and 4. FIG. 3 shows a whole structure of the reflectarray, and FIG. 4 shows an array element that forms the reflectarray.

<Reflectarray>

In the following, a reflectarray according to the present embodiment is described.

Figure 4A:
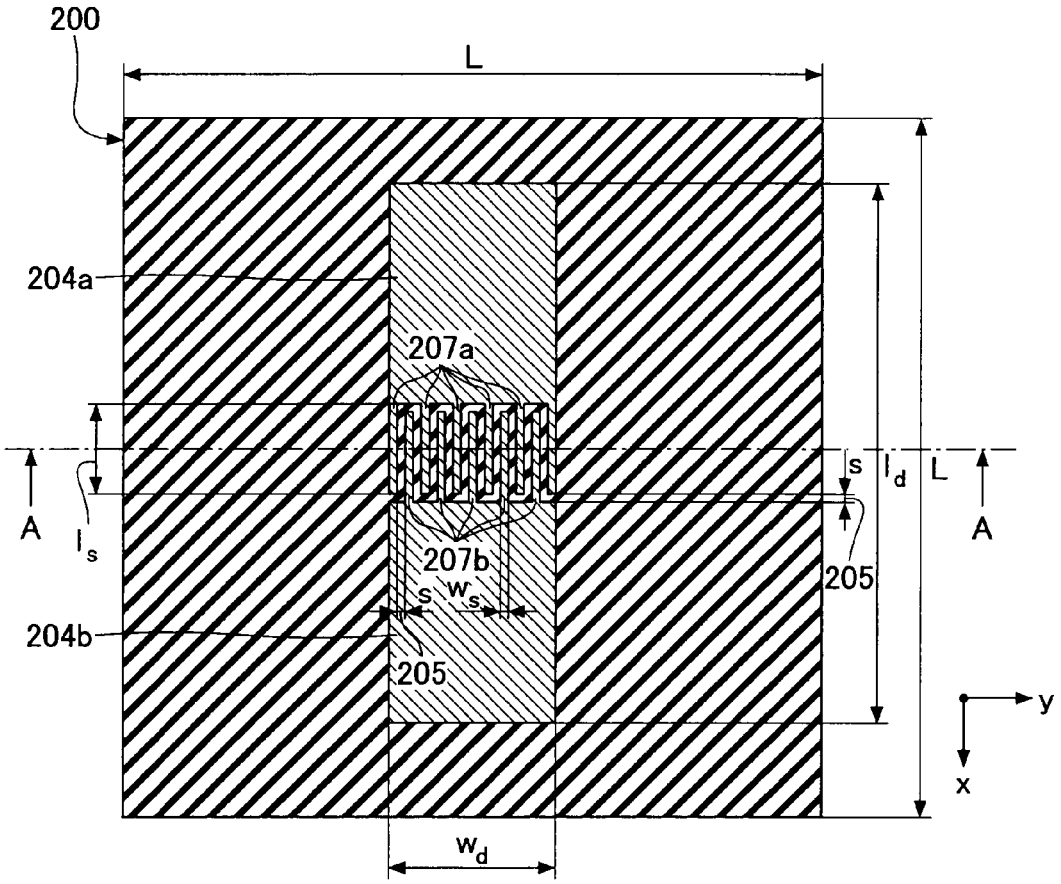
FIGS. 4A and 4B are diagrams (1) showing an array element according to an embodiment of the present invention.

FIG. 3 shows a reflectarray 100 according to the present embodiment. In the reflectarray 100, an array element is formed on each of areas obtained by dividing a principal surface on a substrate. The array element is formed by a plurality of patches. The patches of the array element are placed such that the patches are separated by a predetermined space. In the following, each area on the substrate on which an array element is formed is called an element cell 200. The element cell is also called a periodic cell. Each array element has the same size, that is, each of $l_d$ and $W_d$ shown in FIG. 4A is the same in each array element.

As to the example of the reflectarray shown in FIG. 3, array elements are arranged two-dimensionally in which 7 array elements are arranged in the X direction and 4 array elements are arranged in the Y direction. Alternatively, the reflectarray may be configured such that array elements are arranged one-dimensionally. Also, the number of the array elements to be arranged is not limited to a particular number. Any number of array elements can be arranged. Details of the reflectarray are described later.

<Element Cell>

In the following, the element cell 200 according to the present embodiment is described.

Figure 4B:
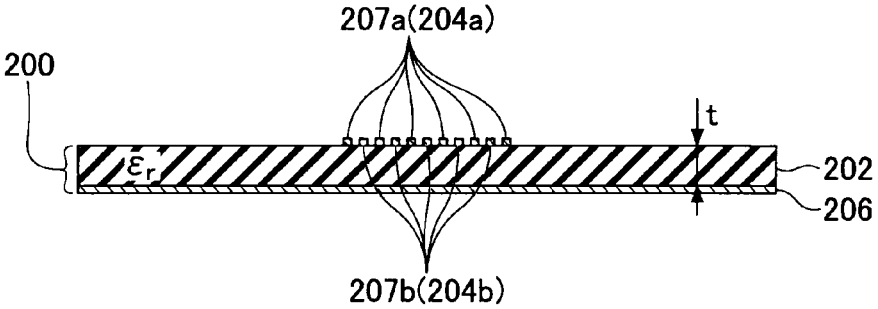

FIGS. 4A and 4B show the element cell 200 according to the present embodiment. FIG. 4A shows a top view (viewed from z direction) and FIG. 4B shows a section view (showing a section indicated by a dashed line of FIG. 4A viewed from the A direction).

In the element cell 200, patches 204*a* and 204*b* are formed on a principal surface, by using a conductor, of a substrate 202 of relative permittivity $\in_r$, wherein the element cell 200 forms a square of L on a side. A dipole is formed by the patches 204*a* and 204*b*. A metal reflector 206 is formed on a surface opposite to the surface of the substrate 202 on which the patches 204*a* and 204*b* are formed. A length of a side of the substrate 202 is indicated as L. The L is also a length of a side of the element cell 200. In another embodiment, the array element may be formed as a rectangle.

For example, a thickness of the substrate is indicated as t.

In the example shown in FIGS. 4A and 4B, a vertical length of the array element is $l_d$, and a lateral length (width) of the array element is $w_d$. A predetermined gap 205 is formed between two adjacent patches. A fringe capacitor is formed between the adjacent patches by the gap 205.

In the present embodiment, the part where the two patches adjoin each other is formed like a comb-shape (207*a*, 207*b*) so that the two patches are engaged with each other while being separated by a predetermined gap. The comb-shape may be also called a meander. A gap of an almost rectangular corrugated shape is formed by arranging the two patches such that the two patches are engaged with each other while they are separated by a predetermined space. The shape of the gap is not limited to a particular shape as long as the gap is formed between the two patches. For example, the gap may be a line shape, or may be an arbitrary curve such as a sine wave shape, or may be a saw-tooth wave shape.

In the example shown in FIGS. 4A and 4B, a vertical length of the fingers 207*a* and 207*b* of the comb-shape is represented by $l_s$, and a lateral length (width) of the finger is represented by $w_s$. In the present embodiment, the gap 205 (interval between adjacent fingers of the two patches) is represented by s. Therefore, a pitch of the comb-shape of one patch is represented by $2(w_s+s)$. The pitch indicates a sum of the interval between the adjacent fingers and the width of the finger of the comb-shape. Also, $w_s=\{w_d-(N-1)s\}/N$ holds true, in which N indicates the number of the fingers. As to the element cell 200 shown in FIGS. 4A and 4B, the total number of the fingers is 11 in which the number of the fingers for the patch 204*a* is 6, and the number for the patch 204*b* is 5.

Figure 5A:
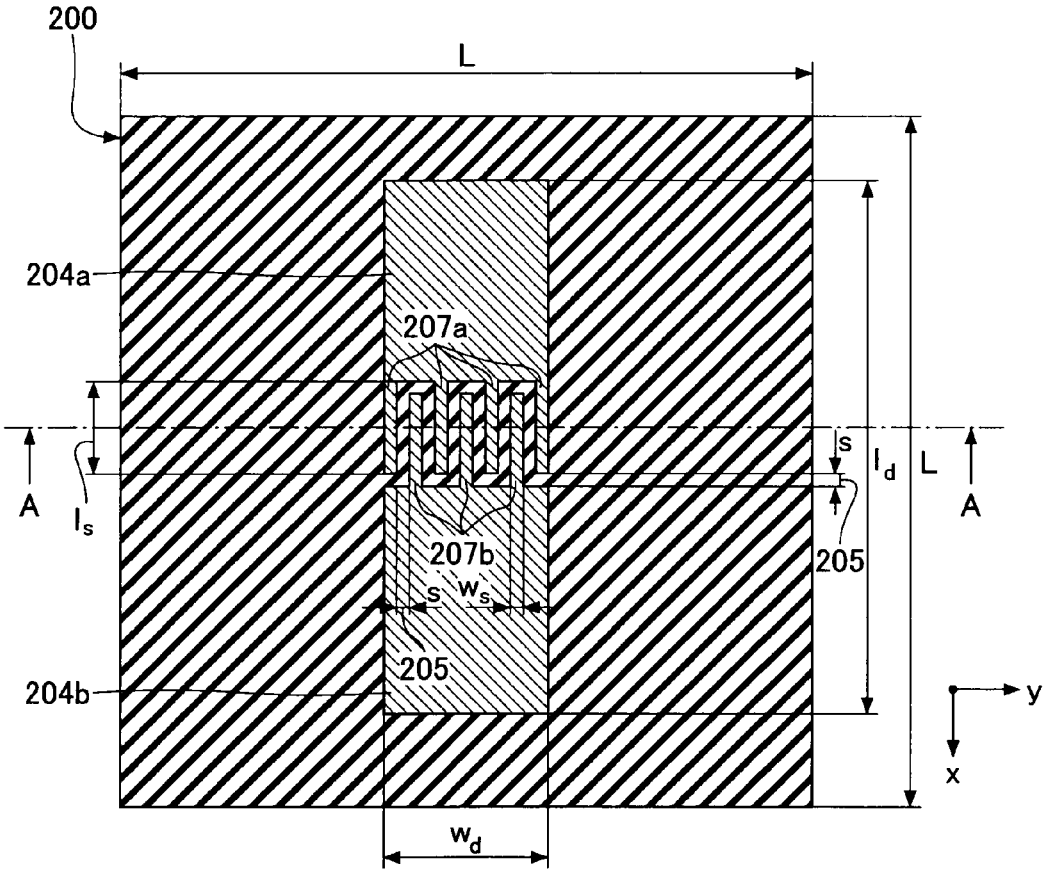
FIGS. 5A and 5B are diagrams (2) showing an array element according to an embodiment of the present invention.
Figure 5B:
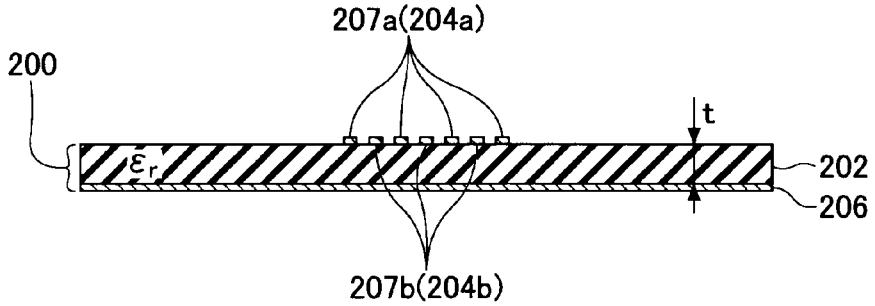

FIGS. 5A and 5B show an example of an array element having a value N different from that of the array element shown in FIGS. 4A and 4B. In the element cell 200 shown in FIGS. 5A and 5B, the number of the fingers for the patch 204*a* is 4 and the number of the fingers for the patch 204*b* is 3, so that the total number is 7.

FIGS. 6, 7A and 7B show examples of dimensions of patches of the element cell 200.

FIG. 6 shows an example of dimensions of the element cell 200 shown in FIGS. 4A and 4B. The frequency of the incident wave is 24 GHz. As shown in FIG. 6, as a design example of the element cell 200 when the incident wave is 24 GHz, L is 5.0 [mm], $l_d$ is 4.0 [mm], $w_d$ is 1.2 [mm], s is 0.05 [mm], t is 0.75 [mm] and $\in_r$ is 2.5.

FIG. 7A shows an example of dimensions of the element cell 200 shown in FIGS. 5A and 5B. The frequency of the incident wave is 12 GHz. As shown in FIG. 7A, as a design example of the element cell 200 when the incident wave is 12 GHz, L is 10.0 [mm], $l_d$ is 8.0 [mm], $w_d$ is 2.6 [mm], s is 0.2 [mm], t is 1.6 [mm] and $\in_r$ is 2.5.

FIG. 7B shows an example of dimensions of the element cell 200 shown in FIGS. 5A and 5B. The frequency of the incident wave is 3 GHz. As shown in FIG. 7B, as a design example of the element cell 200 when the incident wave is 3 GHz, L is 40.0 [mm], $l_d$ is 32.0 [mm], $w_d$ is 9.6 [mm], s is 0.4 [mm], t is 6.0 [mm] and $\in_r$ is 2.5.

Figure 8:
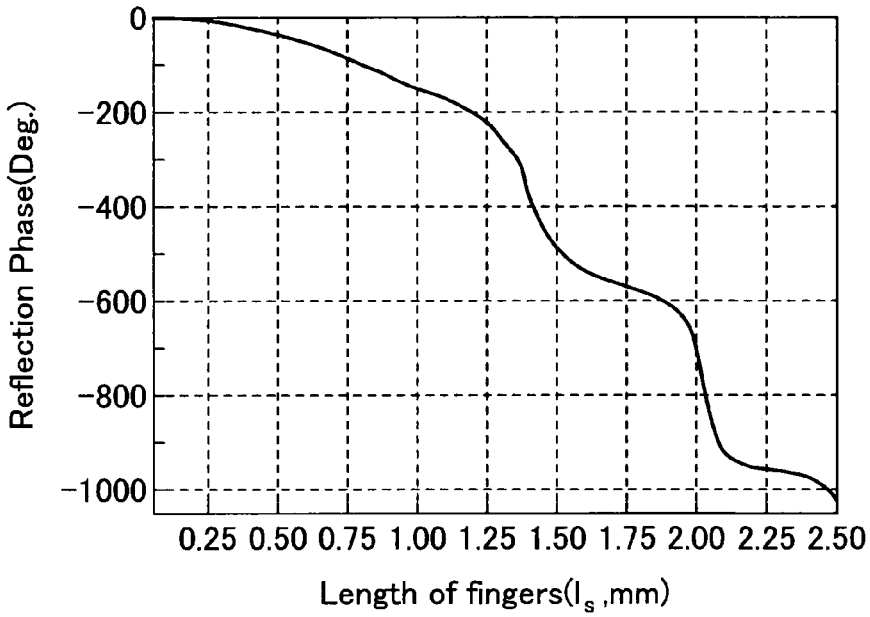
FIG. 8 is a characteristic diagram showing phase characteristics (1) (24 GHz) of reflection coefficient of an array element according to an embodiment of the present invention.
Figure 9:
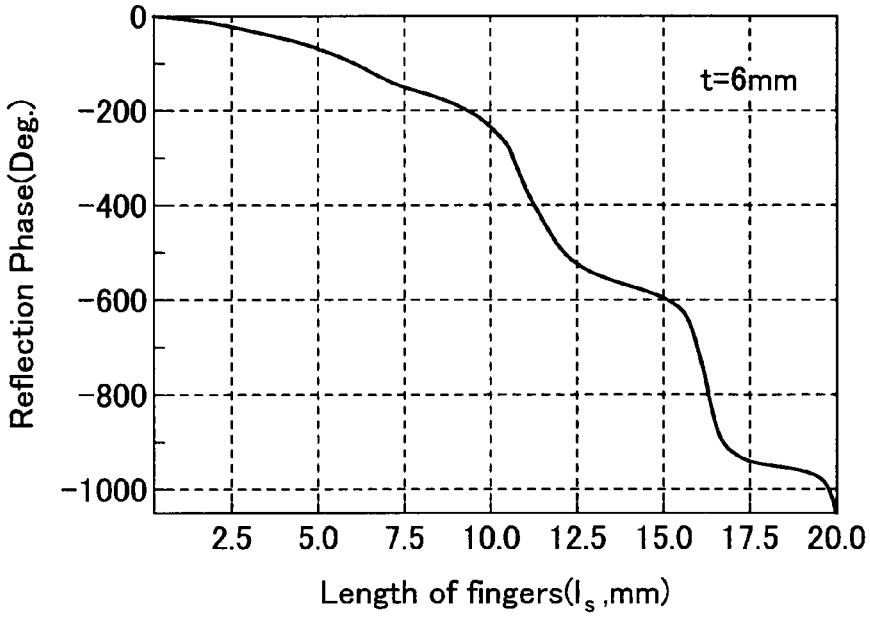
FIG. 9 is a characteristic diagram showing phase characteristics (1) (3 GHz) of reflection coefficient of an array element according to an embodiment of the present invention.
Figure 10:
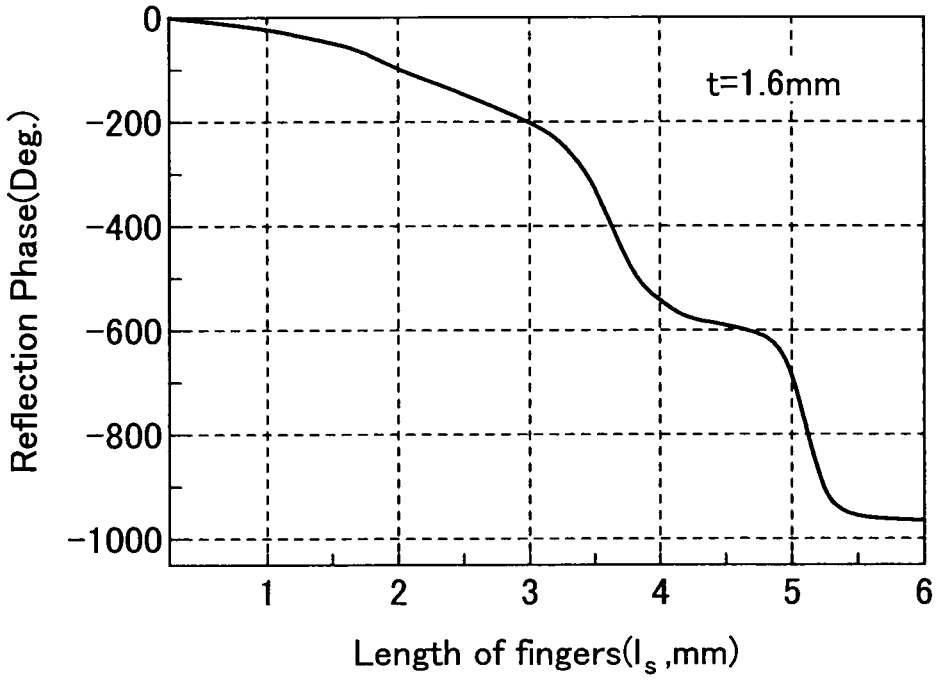
FIG. 10 is a characteristic diagram showing phase characteristics (1) (12 GHz) of reflection coefficient of an array element according to an embodiment of the present invention.

FIGS. 8-10 shows relationship between the phase (degrees) of the reflection coefficient (which can be also called as Reflection Phase) and the vertical length 1, of the fingers (207*a*, 207*b*) of the patch. In FIGS. 8-10, the vertical length $l_s$, of the fingers (207*a*, 207*b*) of the patch is represented as "Length of fingers ($l_s$, mm)". FIGS. 8-10 show a case where a planar wave vertically enters a surface of the array element 200. As to the frequency of the incident wave, FIG. 8 shows a case of 24 GHz, FIG. 9 shows a case of 3 GHz, and FIG. 10 shows a case of 12 GHz. The numbers N of fingers (207*a*, 207*b*) are 11, 11 and 7 in FIGS. 8, 9 and 10 respectively. The values of $w_s$ are 0.06 [mm], 0.5 [mm] and 0.2 [mm] in FIGS. 8, 9 and 10 respectively. The values of t are 0.75 mm, 6 mm and 1.6 mm in FIGS. 8, 9 and 10 respectively.

As the vertical length $l_s$ of the fingers (207*a*, 207*b*) of the patch increases, the length of the gap of the almost rectangular corrugated shape between the two adjacent patches increases. In other words, the longer $l_s$ becomes, the larger the surface area of the part where the adjacent patches adjoin each other becomes.

By varying the length $l_s$ of the fingers, the surface area of each patch that forms the gap between the adjacent patches can be varied. The gap corresponds to a loaded load of scattering elements. The gap can be also changed by the lateral length (width) of the finger (207*a*, 207*b*) of the comb-shape.

According to the element cell 200 of the present embodiment, since the vertical length $l_s$ and/or the lateral length (width) $w_s$ of the finger (207*a*, 207*b*) of the comb-shape of the patches can be varied in a wide range, a load impedance can be adjusted in a wide range. Since the load impedance can be varied in a wide range, it becomes possible to increase the range within which the phase of the reflection coefficient can be adjusted.

As to the element cell 200 of the present embodiment, an example is shown in which the part where the two patches face each other is formed as a comb-shape. According to the present embodiment in which the comb-shape is formed, by varying the length $l_s$ of the fingers of the comb-shape, the surface area of each patch that forms the gap between the adjacent patches can be easily varied. Also, processing for fabrication is easy.

FIGS. 8-10 show that a wide phase range of reflection coefficient can be obtained by adjusting the vertical length $l_s$. More particularly, there is a case where equal to or greater than 1000 degrees can be obtained as the phase range of the reflection coefficient.

The phase of the reflection coefficient may vary according to a frequency to be used and an incident angle.

Figure 11:
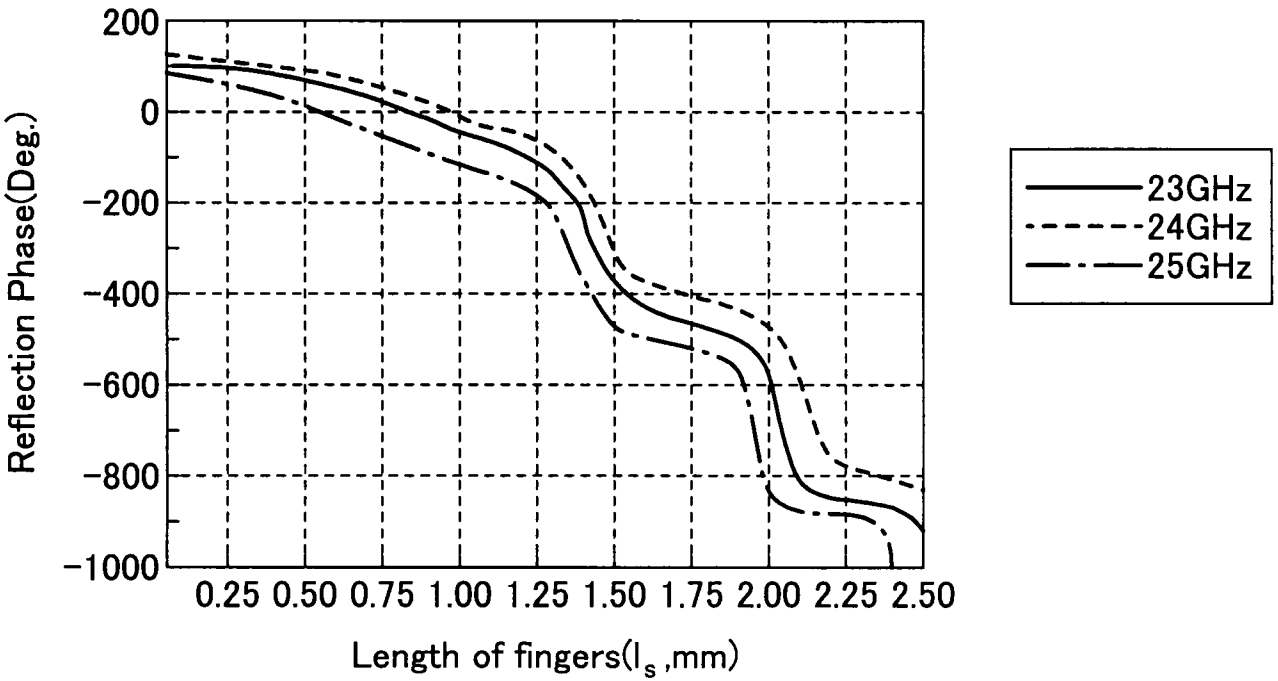
FIG. 11 is a characteristic diagram showing phase characteristics (2) of reflection coefficient of an array element according to an embodiment of the present invention.

FIG. 11 shows relationship between the phase of the reflection coefficient and the vertical length $l_s$ of the fingers (207*a*, 207*b*) of the comb-shape of the patch for different frequencies of incident wave. FIG. 11 shows cases in which the frequencies of the incident wave are 23 GHz, 24 GHz and 25 GHz.

According to FIG. 11, in each of the cases of 23 GHz, 24 GHz and 25 GHz, equal to or greater than 1000 degrees can be obtained as the phase range of the reflection coefficient, which indicates that, the reflectarray of the present embodiment can operate in a wide band by designing the reflectarray in consideration of the band.

Figure 12:
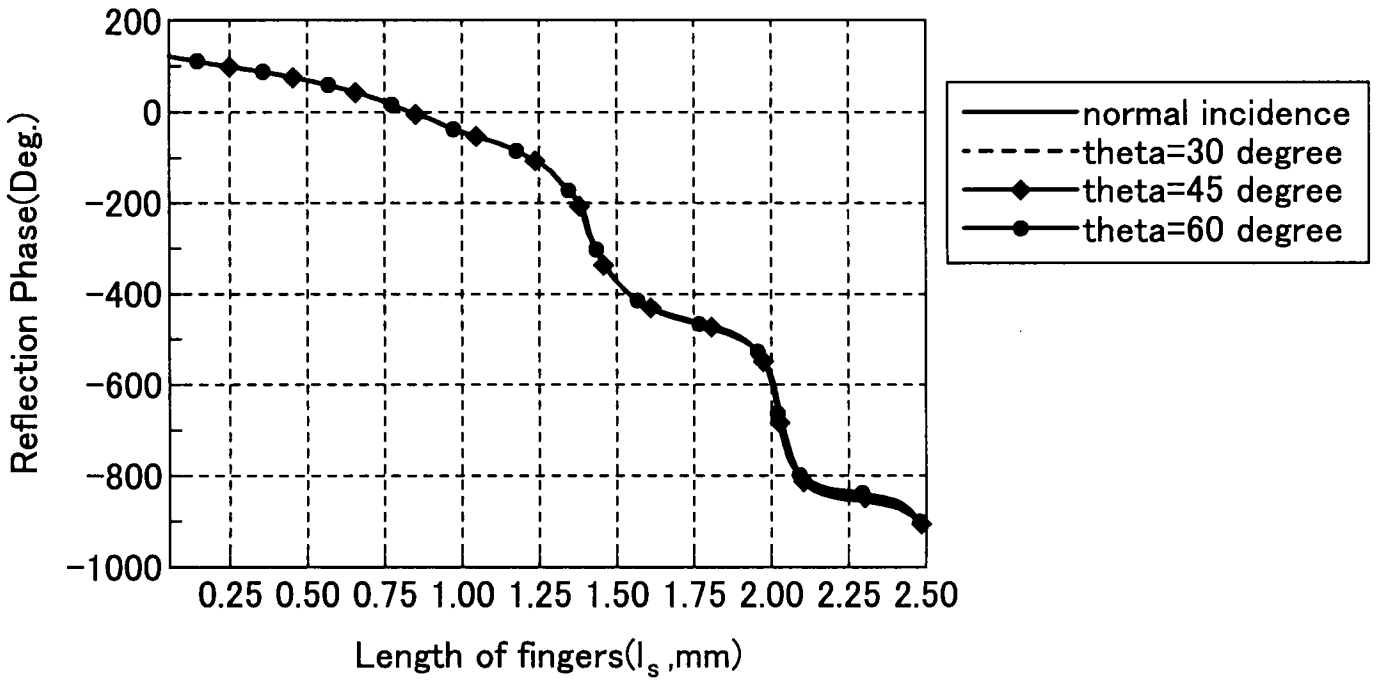
FIG. 12 is a characteristic diagram showing phase characteristics (3) (24 GHz) of reflection coefficient of an array element according to an embodiment of the present invention.

FIG. 12 shows relationship between the phase of the reflection coefficient and the vertical length $l_s$ of the fingers of the comb-shape of the patch for different incident angles. FIG. 12 shows cases in which the incident angles are 30 degrees, 45 degrees and 60 degrees. The incident wave is 24 GHz.

According to FIG. 12, it can be understood that, since an influence of oblique incidence is not large, the influence can be neglected depending on the size of the reflectarray. However, when the size of the reflectarray becomes large to some extent, it is preferable to consider the influence.

<Reflectarray (1)>

Figure 13:
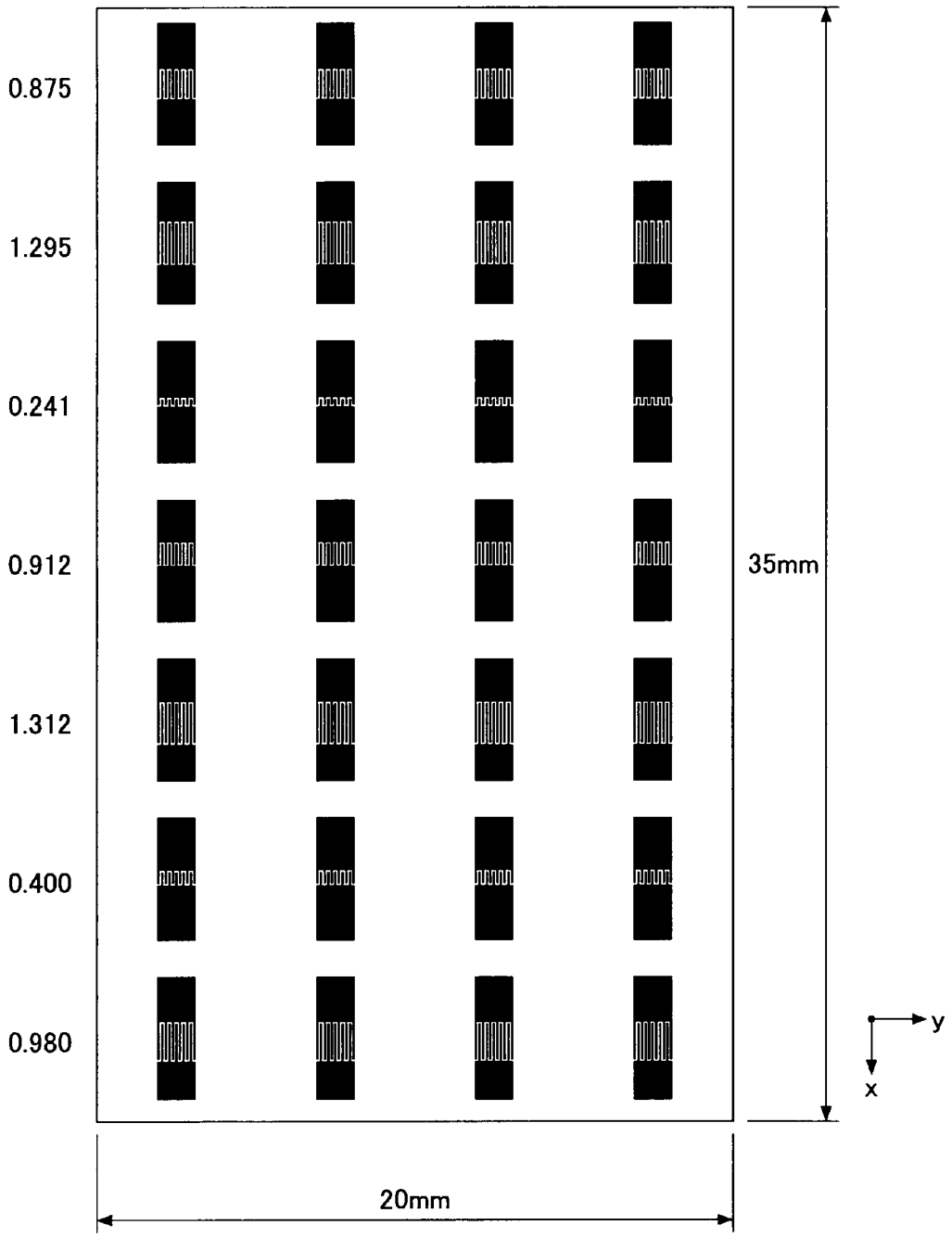
FIG. 13 is a diagram showing a reflectarray (1) according to an embodiment of the present invention.

FIG. 13 shows a design example (1) of a reflectarray.

In the reflectarray shown in FIG. 13, similarly to the reflectarray shown in FIG. 3, array elements are arranged two-dimensionally in which 7 array elements are arranged in the X direction and 4 array elements are arranged in the Y direction. In this case, the incident wave is 24 GHz. The size of the reflectarray is 35 [mm] in the X direction and is 20 [mm] in the Y direction. The value of t is 0.75 mm. The sizes of each array are almost the same.

Regarding the reflectarray shown in FIG. 13, in the vertical lines, in other words, in the array elements arranged in the X direction, the vertical length $l_s$ of the fingers of the comb-shape is different between adjacent array elements. Each of the numerical values shown in the left side of FIG. 13 indicates the vertical length $l_s$ [mm] of the fingers of the comb-shape of a corresponding array element.

In the lateral lines, in other words, in the array elements arranged in the Y direction, the vertical length $l_s$ of the fingers of the comb-shape is the same between adjacent array elements.

Each vertical length of the fingers of the comb-shape shown in the figure is merely an example, and the length is changeable as necessary. For example, the reflectarray may be configured such that the vertical length $l_s$ of the fingers is the same between array elements adjacent in the X direction, and that the vertical length $l_s$ of the fingers is different between array elements adjacent in the Y direction. Also, the length may be different between at least a part of array elements and other array elements. Also, the length may be the same in all of the array elements.

Since the main beam is scanned only in the X-Z plane, the reflectarray is configured such that the vertical length $l_s$ of the fingers is different between adjacent array elements arranged in the X direction, and that the vertical length $l_s$ of the fingers is the same between adjacent array elements arranged in the Y direction.

FIG. 14 shows an example of design dimensions and compensation phase (degree) of the reflectarray 100 shown in FIG. 13.

According to FIG. 14, the phase compensated between the array elements that are adjacent in the X direction is about 120 degree.

Figure 15:
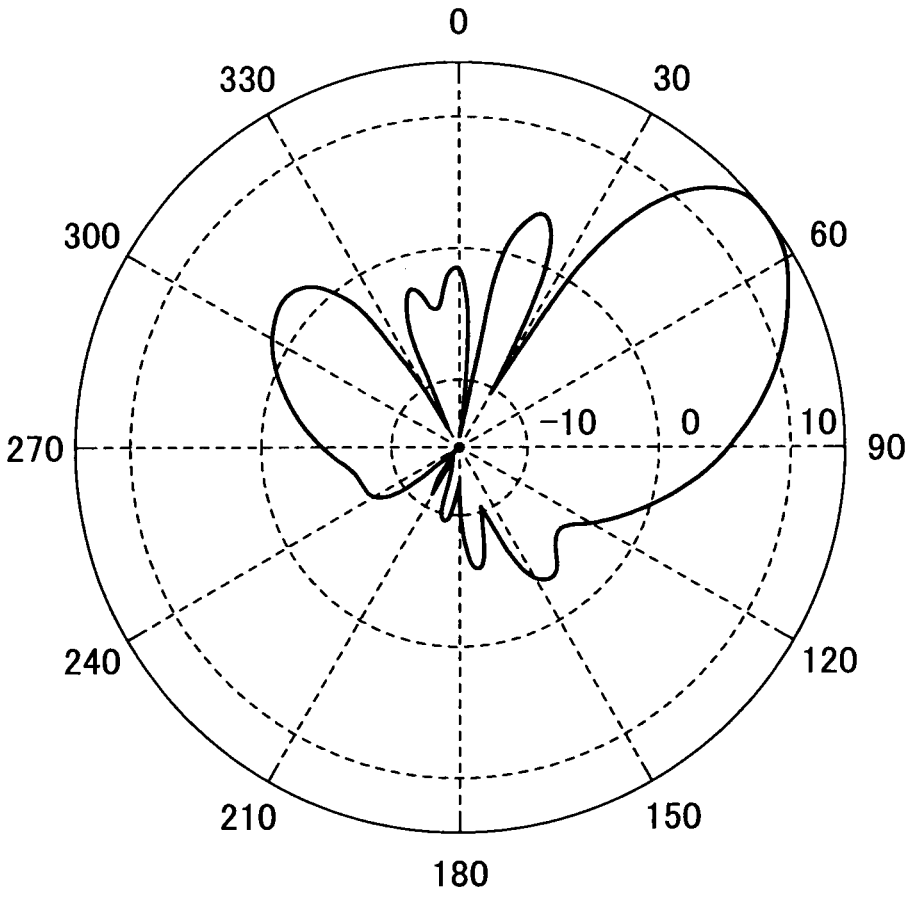
FIG. 15 is a diagram showing an example of a radiation pattern of a reflectarray (1) according to an embodiment of the present invention.

FIG. 15 shows an example of a radiation pattern of the reflectarray 100 of the present embodiment. When the incident wave is 3 GHz, directivity becomes the maximum. The directivity is 14.1 [dBi]. The direction in which the directivity becomes the maximum is 58 degrees while the design value is 60 degrees, which indicates that difference from the design value of the 58 degrees is small.

<Reflectarray (2)>

Figure 16:
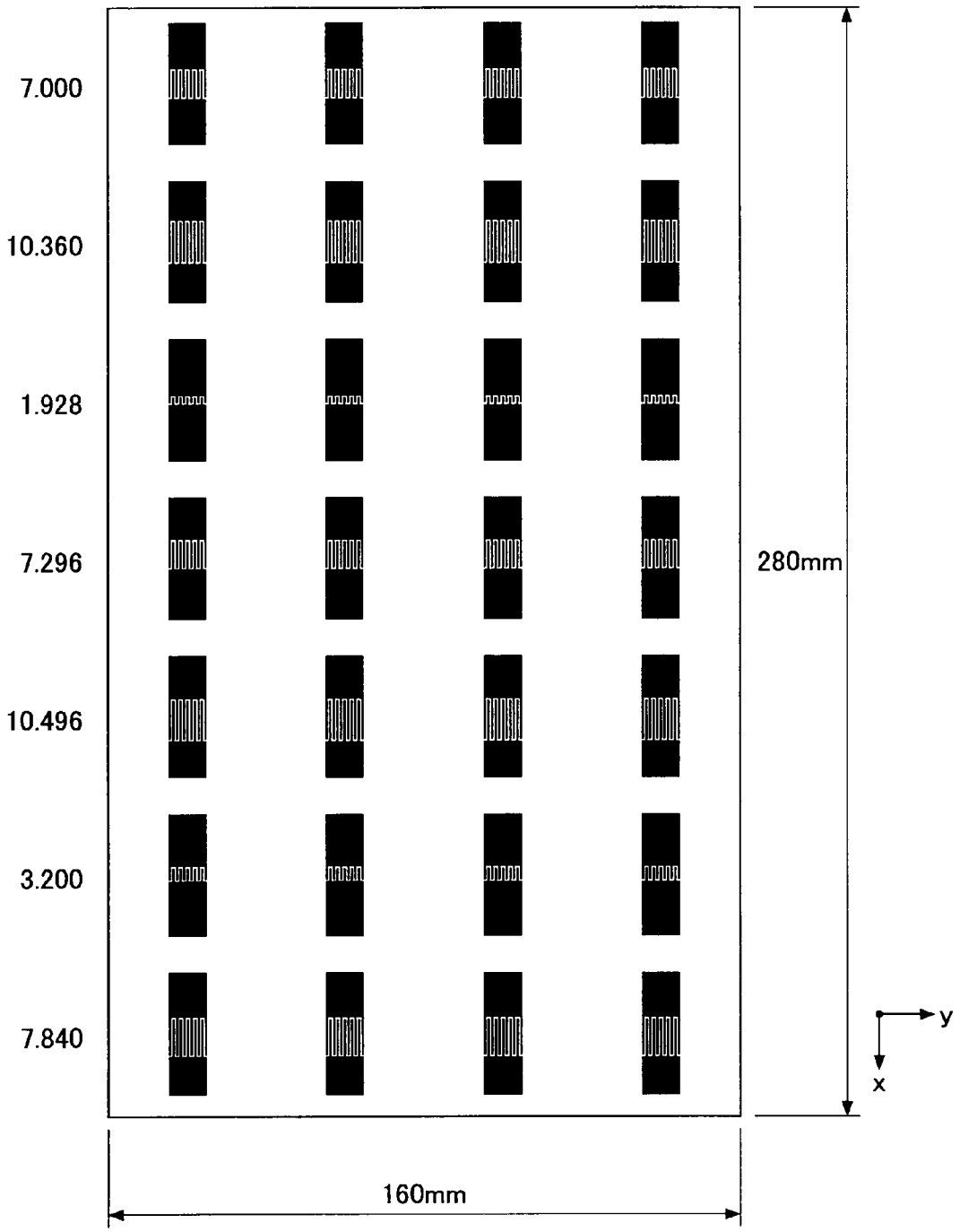
FIG. 16 is a diagram showing a reflectarray (2) according to an embodiment of the present invention.

FIG. 16 shows a design example (2) of a reflectarray.

In the reflectarray shown in FIG. 16, similarly to the reflectarray shown in FIG. 3, array elements are arranged two-dimensionally in which 7 array elements are arranged in the X direction and 4 array elements are arranged in the Y direction. In this case, the incident wave is 3 GHz. The size of the reflectarray is 280 [mm] in the X direction and is 160 [mm] in the Y direction. The value of t is 6 mm. The sizes of each array element are almost the same.

Regarding the reflectarray shown in FIG. 16, in the vertical lines, in other words, in the array elements arranged in the X direction, the vertical length $l_s$ of the fingers of the comb-shape is different between adjacent array elements. Each of the numerical values shown in the left side of FIG. 16 indicates the vertical length $l_s$ [mm] of the fingers of the comb-shape of a corresponding array element.

In the lateral lines, in other words, in the array elements arranged in the Y direction, the vertical length $l_s$ of the fingers of the comb-shape is the same between adjacent array elements.

Each vertical length of the fingers shown in the figure is merely an example, and the length is changeable as necessary. For example, the reflectarray may be configured such that the vertical length $l_s$ of the fingers is the same between array elements adjacent in the X direction, and that the vertical length $l_s$ of the fingers is different between array elements adjacent in the Y direction. Also, the length may be different between at least a part of array elements and other array elements. Also, the length may be the same in all of the array elements.

Since the main beam is scanned only in the X-Z plane, the reflectarray is configured such that the vertical length 1, of the fingers is different between adjacent array elements arranged in the X direction, and that the vertical length $l_s$ of the fingers is the same between adjacent array elements arranged in the Y direction.

FIG. 17 shows an example of design dimensions and compensation phase (degrees) of the reflectarray shown in FIG. 16.

According to FIG. 17, the phase compensated between the array elements that are adjacent in the X direction is about 120 degrees.

<Reflectarray (3)>

Figure 18:
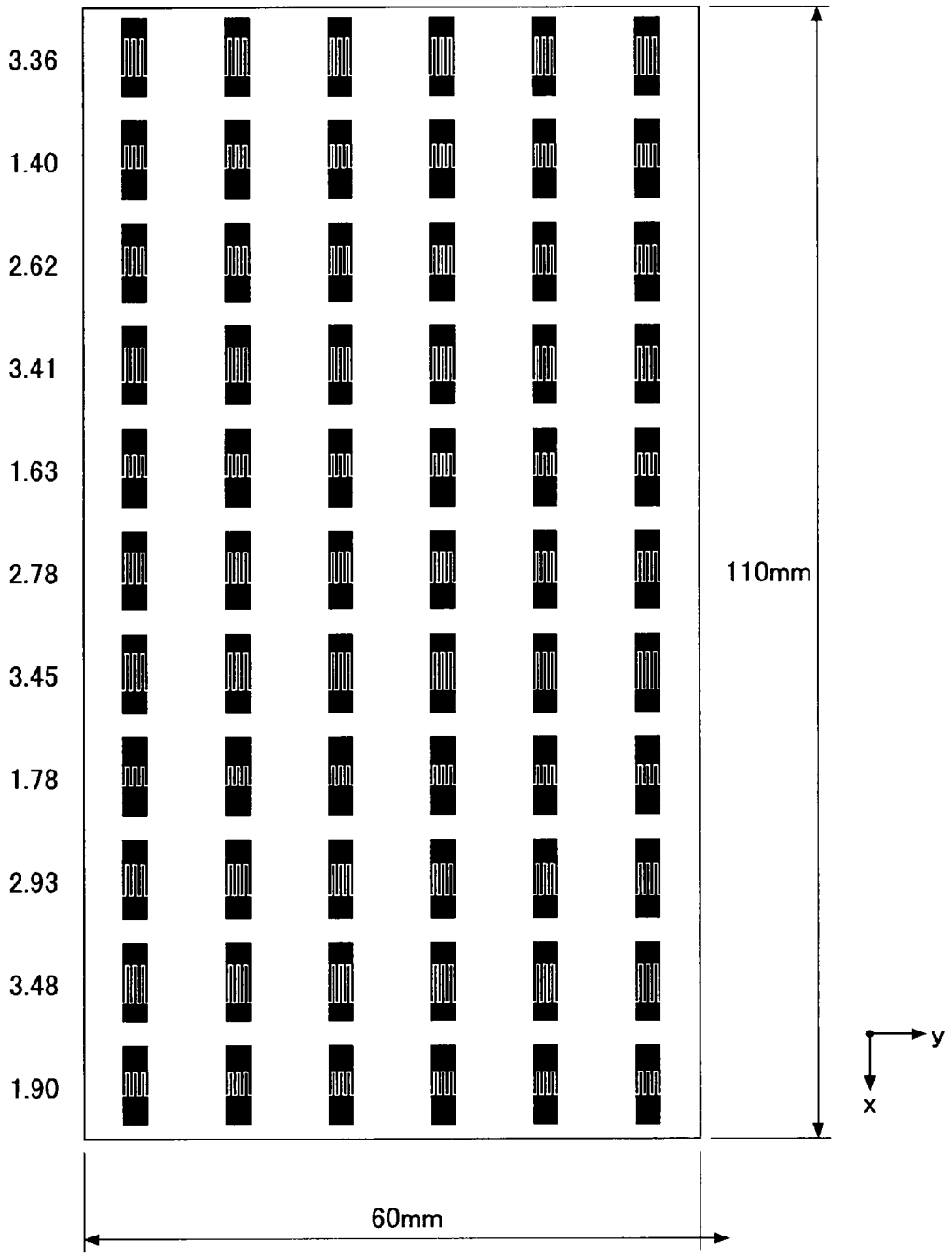
FIG. 18 is a diagram showing a reflectarray (3) according to an embodiment of the present invention.

FIG. 18 shows a design example (3) of a reflectarray.

In the reflectarray shown in FIG. 18, different from the reflectarray shown in FIG. 3, array elements are arranged two-dimensionally in which 11 array elements are arranged in the X direction and 6 array elements are arranged in the Y direction. In this case, the incident wave is 12 GHz. The size of the reflectarray is 110 [mm] in the X direction and is 60 [mm] in the Y direction. The value of t is 1.6 mm. The sizes of each array are almost the same.

Regarding the reflectarray shown in FIG. 18, in the vertical lines, in other words, in the array elements arranged in the X direction, the vertical length $l_s$ of the fingers of the comb-shape is different between adjacent array elements. Each of the numerical values shown in the left side of FIG. 18 indicates the vertical length $l_s$ [mm] of the fingers of the comb-shape of a corresponding array element.

In the lateral lines, in other words, in the array elements arranged in the Y direction, the vertical length $l_s$ of the fingers of the comb-shape is the same between adjacent array elements.

Each vertical length of the fingers of the comb-shape shown in the figure is merely an example, and the length is changeable as necessary. For example, the reflectarray may be configured such that the vertical length $l_s$ of the fingers is the same between array elements adjacent in the X direction, and that the vertical length $l_s$ of the fingers is different between array elements adjacent in the Y direction. Also, the length may be different between at least a part of array elements and other array elements. Also, the length may be the same in all of the array elements.

Since the main beam is scanned only in the X-Z plane, the reflectarray is configured such that the vertical length $l_s$ of the fingers of the comb-shape is different between adjacent array elements arranged in the X direction, and that the vertical length $l_s$ of the fingers of the comb-shape is the same between adjacent array elements arranged in the Y direction.

FIG. 19 shows an example of design dimensions and compensation phase (degrees) of the reflectarray shown in FIG. 18.

According to FIG. 19, the phase compensated between the array elements that are adjacent in the X direction is about 120 degrees.

Figure 20:
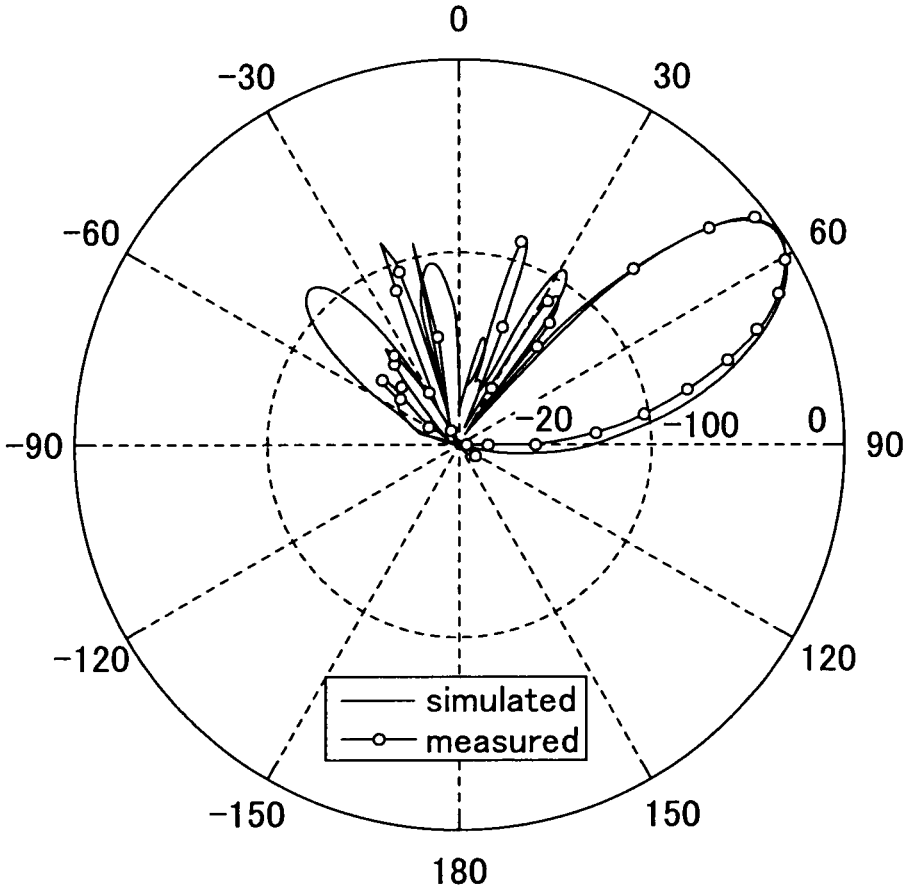
FIG. 20 is a diagram showing an example of a radiation pattern of a reflectarray (3) according to an embodiment of the present invention.

FIG. 20 shows an example of a radiation pattern of the reflectarray 100 of the present embodiment. The incident wave is 12 GHz, and the directivity gain is 17 [dBi]. The direction in which the directivity becomes the maximum is 58 degrees while the design value is 60 degrees, which indicates that difference from the design value of the 58 degrees is small.

According to the element cell of the present embodiment, by adjusting the gap formed between the adjacent patches, a load impedance can be adjusted in a wide range. Since the load impedance can be adjusted in a wide range, it becomes possible to widen the range within which the phase of the reflection coefficient can be adjusted. In the element cell, since it becomes possible to widen the range within which the phase of the reflection coefficient can be adjusted, it also becomes possible to widen the range within which the phase of the reflection coefficient can be adjusted in a reflectarray where a plurality of element cells are arranged. More particularly, by varying the vertical length $l_s$ and/or the lateral length (width) $w_s$ of the fingers (207*a*, 207*b*) of the comb-shape of the patches, a load impedance can be adjusted in a wide range. Since the load impedance can be adjusted in a wide range, it becomes possible to widen the range within which the phase of the reflection coefficient can be adjusted.

According to the element cell of the present embodiment, by adjusting the gap formed between the adjacent patches, it becomes possible to widen the range within which the phase of the reflection coefficient can be adjusted. Therefore, in a reflectarray where a plurality of element cells are arranged, it becomes possible to widen the range within which the phase of the reflection coefficient can be adjusted without varying the size of each array element. Since it is not necessary to vary the size of the array element, characteristic deterioration of the reflectarray can be decreased, the characteristic deterioration being caused by variations of spaces between adjacent array elements.

Modified Example (1)

<Reflectarray>

The reflectarray of the present modified example is similar to reflectarrays shown in FIGS. 3 and 13.

<Element Cell>

In the following, an element cell according to the present modified example is described.

Figure 21A:
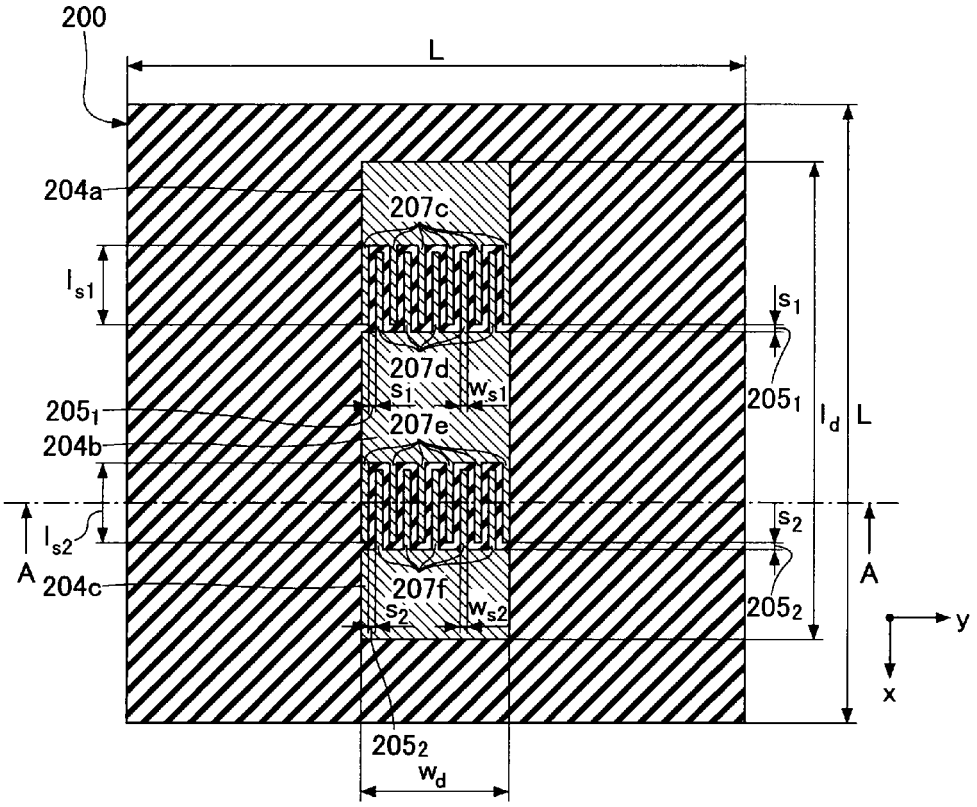
FIGS. 21A and 21B are diagrams showing an array element according to an embodiment of the present invention.
Figure 21B:
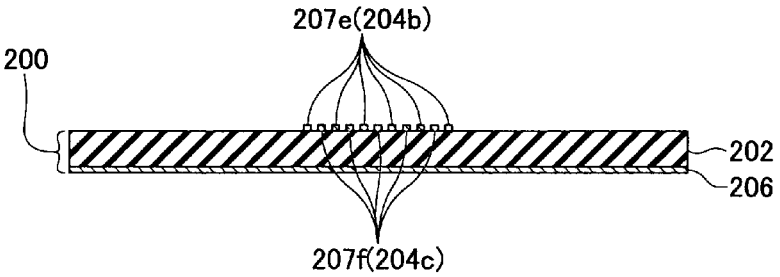

FIGS. 21A and 21B show an element cell 200 according to the present modified embodiment. FIG. 21A shows a top view (viewed from z direction) and FIG. 21B shows a section view (a section indicated by a dashed line in FIG. 21A viewed from the A direction).

In the element cell 200, patches 204*a*, 204*b* and 204*c* are formed on a principal surface, by using a conductor, of a substrate 202. A metal reflector 206 is formed on a surface opposite to the surface of the substrate 202 on which the patches 204*a*, 204*b* and 204*c* are formed. A length of a side of the element cell is indicated as L.

For example, the substrate 202 is formed by a dielectric. A relative permittivity of the substrate 202 is represented by $\in_r$. A thickness of the substrate 202 is indicated as t.

In the example shown in FIGS. 21A and 21B, a vertical length of the array element is $l_d$, and a lateral length (width) of the array element is $w_d$. A predetermined gap is formed between two adjacent patches. A fringe capacitor is formed between the adjacent patches by the gap.

In the element cell 200 of the present modified example, the part where two patches adjoin each other is formed like a comb-shape (207*c*, 207*b*, 207*e*, 207*f*) so that the two patches are engaged with each other while being separated by a predetermined interval. Thus, a gap of an almost rectangular corrugated shape is formed. The shape of the gap is not limited to the shape shown in the figure as long as the gap is formed between the two patches. For example, the gap may be a line shape, or may be an arbitrary curve such as a sine wave shape, or may be a saw-tooth wave shape.

As to the example shown in FIGS. 21A and 21B, in the patch 204*a* and the patch 204*b* that is adjacent to the patch 204*a*, a vertical length of the fingers 207*c* and 207*d* of the comb-shape is represented by $l_{s1}$, and a lateral length (width) of each finger is represented by $w_{s1}$. The gap $\mathbf{205}_1$ between adjacent fingers of the two patches is represented by $s_1$. Therefore, a pitch of the comb-shape of a patch is represented by 2 ($w_{s1}+s_1$). The pitch indicates a sum of the gap between the adjacent fingers and the width of the finger of the comb-shape. Also, $w_{s1}=\{w_d-(N-1)s_1\}/N$ holds true, in which N indicates the number of fingers. As to the array element 200 shown in FIGS. 21A and 21B, the total number of the fingers is 11 in which the number of the fingers for the patch 204*a* is 6, and the number for the patch 204*b* adjacent to the patch 204*a* is 5. The value of $s_1$ indicates an interval between adjacent fingers.

Also, in the patch 204*b* and the patch 204*c* that is adjacent to the patch 204*b*, a vertical length of the fingers 207*e* and 207*f* of the comb-shape is represented by $l_{s2}$, and a lateral length (width) of each finger is represented by $w_{s2}$. The gap $\mathbf{205}_2$ between the adjacent fingers of the two patches is represented by $s_2$. Therefore, a pitch of the comb-shape of a patch is represented by 2 ($w_{s2}+s_2$). The pitch indicates a sum of the gap between the adjacent fingers and the width of a finger of the comb-shape. Also, $w_{s2}=\{w_d-(N-1)s_2\}/N_2$ holds true, in which $N_2$ indicates the number of fingers. As to the element cell 200 shown in FIGS. 21A and 21B, the total number of the fingers is 11 in which the number of the fingers for the patch 204*b* is 6, and the number for the patch 204*c* adjacent to the patch 204*b* is 5. The value of $s_2$ indicates an interval between adjacent fingers. N and $N_2$ may be the same or may be different.

The lengths $l_{s1}$ and $l_{s2}$ of the fingers may be the same or may be different. Also, the lateral lengths (widths) $w_{s1}$ and $w_{s2}$ of the fingers may be the same or may be different. Also, the gaps $s_1$ and $s_2$ between adjacent fingers of two patches may be the same or may be different.

In the present modified example, although a case where the number of gaps between patches formed on the element cell 200 is 2 is described, the number may be equal to or more than 3. In the case when the number of gaps between patches is equal to or more than 3, the shape of each gap may be the same or may be different.

Modified Example (2)

<Reflectarray>

The reflectarray of the present modified example is similar to reflectarrays shown in FIGS. 3 and 13.

<Element Cell>

In the following, an element cell 200 according to the present modified example is described.

Figure 22A:
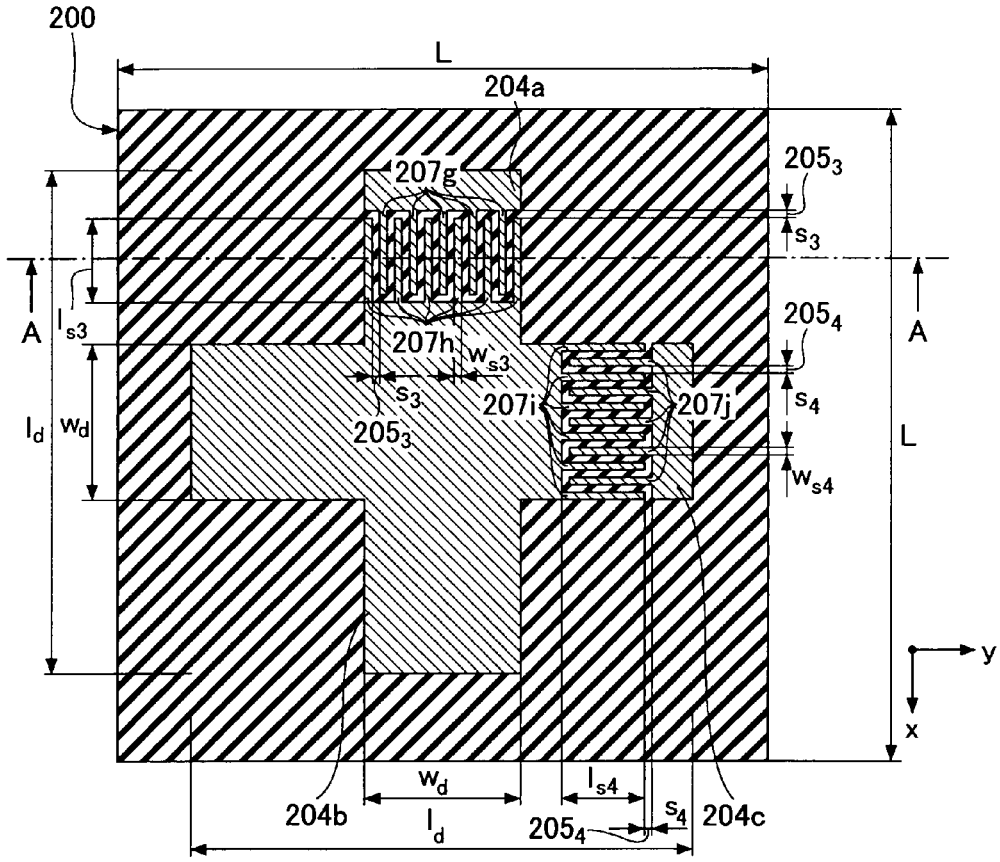
FIGS. 22A and 22B are diagrams showing an array element according to an embodiment of the present invention.
Figure 22B:
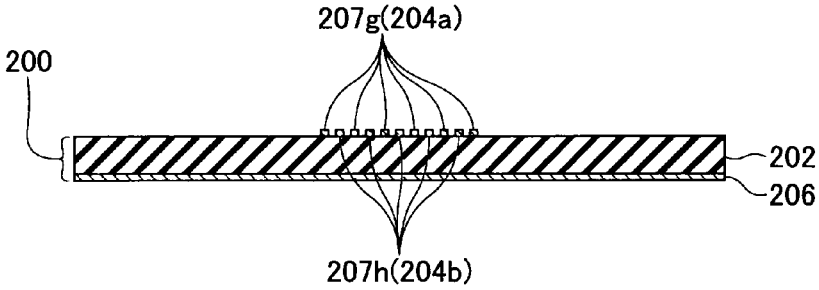

FIGS. 22A and 22B show an element cell 200 according to the present modified embodiment. FIG. 22A shows a top view (viewed from z direction) and FIG. 22B shows a section view (a section indicated by a dashed line in FIG. 22A viewed from the A direction). In the above-mentioned embodiments and modified example, the shape of the dipole is not limited to a rectangle. As an example of a shape other than the rectangle, a case is described in which the shape of the dipole is configured to be a cross shape.

In the element cell 200, patches 204*a*, 204*b* and 204*c* are formed on a principal surface, by using a conductor, of a substrate 202. A metal reflector 206 is formed on a surface opposite to the surface of the substrate 202 on which the patches 204*a*, 204*b* and 204*c* are formed. A length of a side of the element cell 200 is indicated as L.

For example, the substrate 202 is formed by a dielectric. A relative permittivity of the substrate 202 is represented by $\in_r$. A thickness of the substrate 202 is represented by t.

In the example shown in FIGS. 22A and 22B, the dipole has a shape in which parts of two patches overlap, wherein a vertical length of each patch is $l_d$, and a lateral length (width) of each patch is $w_d$. A predetermined gap is formed between two adjacent patches. A fringe capacitor is formed between the adjacent patches by the gap.

In the element cell 200 of the present modified example, the part where two patches adjoin each other is formed like a comb-shape (207*g*, 207*h*, 207*i*, 207*j*) so that the two patches are engaged with each other while being separated by a predetermined space. A gap of an almost rectangular corrugated shape is formed by arranging the two patches such that the two patches are engaged with each other while they are separated by a predetermined space. The shape of the gap is not limited to the shape shown in the figure as long as the gap is formed between the two patches. For example, the gap may be a line shape, or may be an arbitrary curve such as a sine wave shape, or may be a saw-tooth wave shape.

As to the example shown in FIGS. 22A and 22B, in the patch 204*a* and the patch 204*b* that is adjacent to the patch 204*a*, a vertical length of the fingers 207*g* and 207*h* of the comb-shape is represented by $l_{s3}$, and a lateral length (width) of each finger is represented by $w_{s3}$. The gap $\mathbf{205}_3$ between the adjacent fingers of the two patches is represented by $s_3$. Therefore, a pitch of the comb-shape of a patch is represented as 2 ($w_{s3}+s_{13}$). The pitch indicates a sum of the interval between the adjacent fingers and the width of a finger of the comb-shape. Also, $w_{s3}=\{w_d-(N-1)s_3\}/N_2$ holds true, in which N indicates the number of fingers. As to the element cell 200 shown in FIGS. 22A and 22B, the total number of the fingers is 11 in which the number of the fingers for the patch 204*a* is 5, and the number for the patch 204*b* adjacent to the patch 204*a* is 6. The value of $s_3$ indicates an interval between adjacent fingers. N and $N_2$ may the same or may be different.

Also, in the patch 204*b* and the patch 204*c* that is adjacent to the patch 204*b*, a vertical length of the fingers 207*i* and 207*j* of the comb-shape is represented by $l_{s4}$, and a lateral length (width) of each finger is represented by $w_{s4}$. The gap $\mathbf{205}_4$ of the adjacent fingers of the two patches is represented by $s_4$. Therefore, a pitch of the comb-shape of a patch is represented by 2 ($w_{s4}+s_4$). The pitch indicates a sum of the interval between the adjacent fingers and the width of a finger of the comb-shape. Also, $w_{s4}=\{w_d-(N-1)\ s_4\}/N_2$ holds true, in which N indicates the number of fingers. As to the element cell 200 shown in FIGS. 22A and 22B, the total number of the fingers is 11 in which the number of the fingers for the patch 204*b* is 6, and the number for the patch 204*c* adjacent to the patch 204*b* is 5. The value of $s_4$ indicates an interval between adjacent fingers. N and $N_2$ may the same or may be different.

The lengths $l_{s3}$ and $l_{s4}$ of the fingers may be the same or may be different. Also, the lateral lengths (widths) $w_{s3}$ and $w_{s4}$ of the fingers may be the same or may be different. Also, the gaps $s_3$ and $s_4$ between adjacent fingers may be the same or may be different.

In the present modified example, although a case where the number of gaps between patches formed on the element cell 200 is 2 is described, the number may be equal to or more than 3. In the case when the number of gaps between patches is equal to or more than 3, the shape of each gap may be the same or may be different.

Figures 23A, 23B, 23C:
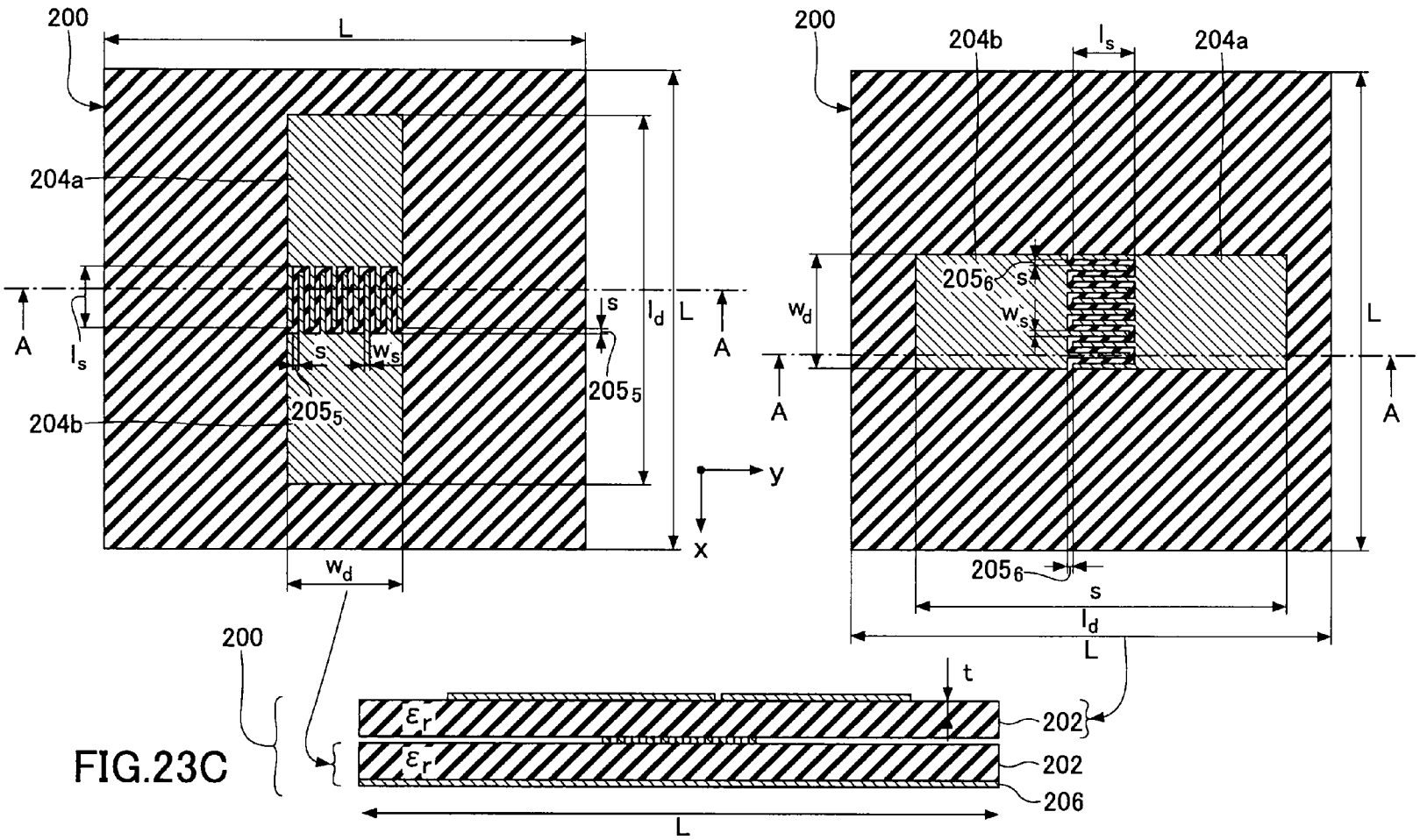
FIGS. 23A-23C are diagrams showing an array element according to an embodiment of the present invention.

FIGS. 23A-23C show an element cell 200 according to the present modified example. In the element cell 200, a multilayer structure is adopted using three conductive layers and two dielectric layers. Further, a multilayer cross dipole reflectarray is configured by crossing directions of dipoles of the first conductive layer and the second conductive layer. According to the array element of the present modified example, a cross dipole reflectarray can be realized that can vary phases without varying the size of patches.

Figure 24A:
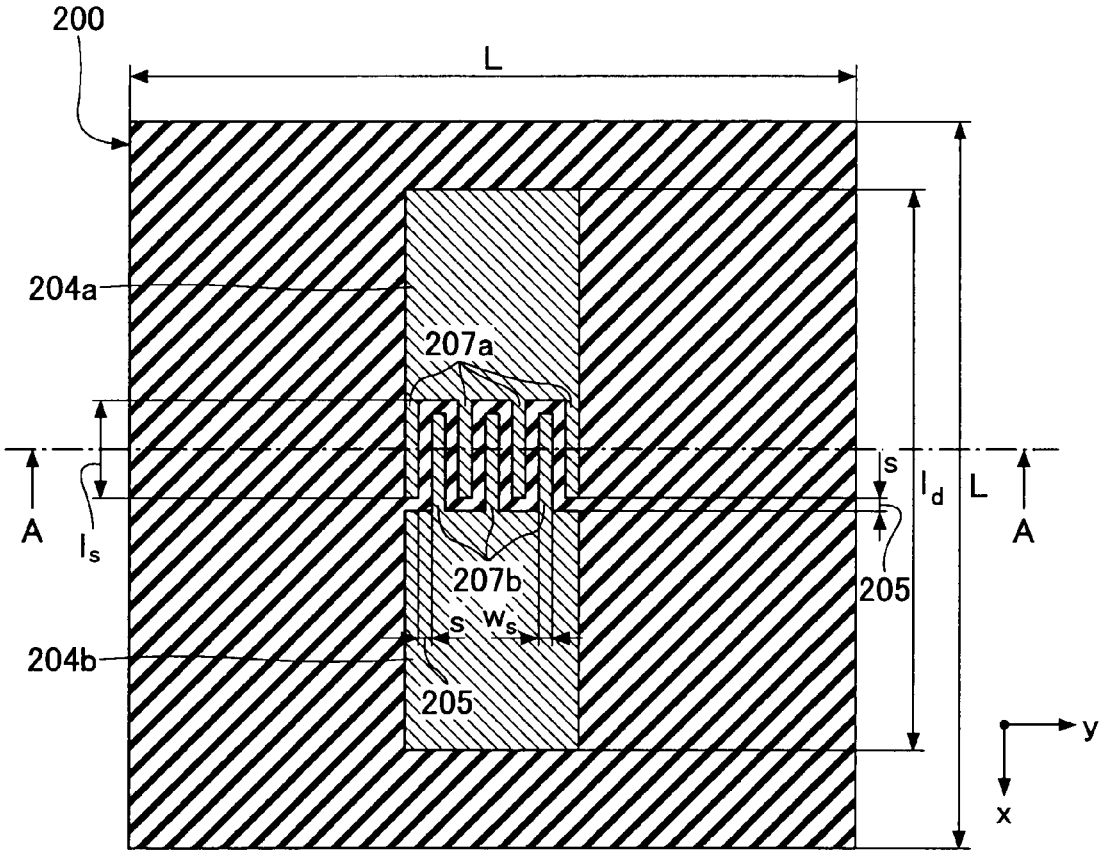
FIGS. 24A and 24B are diagrams showing an array element (an example in which the reflector is not provided) according to an embodiment of the present invention.
Figure 24B:
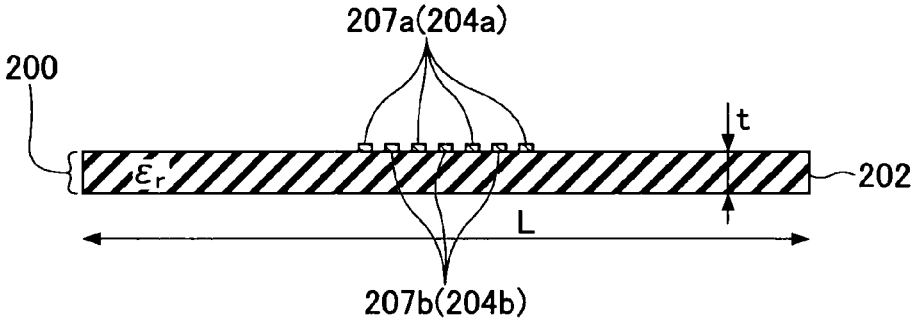

FIGS. 24A and 24B show an array element according to an embodiment of the present invention. The array element is an example in which a metal reflector is not used.

According to the present embodiment and the modified examples, a reflectarray is realized.

The reflectarray, includes:

a substrate; and a plurality of patches formed on each of areas into which a principal surface of the substrate is divided, wherein the plurality of patches are formed by including a gap.

By adjusting the gap formed between adjacent patches, the load impedance can be adjusted in a wide range. Since the load impedance can be adjusted in a wide range, it becomes possible to widen the range within which the phase of the reflection coefficient can be adjusted.

In the reflectarray, a shape of an edge of a patch to which another patch adjoins is a comb-shape.

By forming the part where two patches adjoins each other to be a comb-shape, the surface area of each patch that forms the gap formed between adjacent patches can be easily varied by varying the length $l_s$ of the finger. Also, processing becomes easy.

In the reflectarray, a height and/or a width of a finger of the comb-shape in at least a part of the plurality of patches is different from another patch of the plurality of patches.

By adjusting the gap formed between adjacent patches, the load impedance can be adjusted further in a wide range. Since the load impedance can be adjusted in a wide range, it becomes possible to further widen the range within which the phase of the reflection coefficient can be adjusted.

In the reflectarray, at least one of a size of the gap, a shape of the gap, a length of the gap, a width of the gap and a ratio between the length and the width of the gap of the plurality of patches formed in at least a part of the areas is different from corresponding one of the plurality of patches formed in another area.

Accordingly, the phase of the reflection coefficient can be varied between element cells.

In the reflectarray, a size of the plurality of patches is the same in each of the areas.

Accordingly, the deterioration of characteristics of the reflectarray can be reduced, wherein the deterioration is caused by variation of sizes between adjacent array elements.

The reflectarray may further includes a metal plate that is formed on a surface opposite to the principal surface and that functions as a reflector.

Although the present invention has been described with reference to specific embodiments, these embodiments are simply illustrative, and various variations, modifications, alterations, substitutions and so on could be conceived by those skilled in the art. The present invention has been described using specific numerals in order to facilitate understandings of the present invention, but unless specifically stated otherwise, these numerals are simply illustrative, and any other appropriate value may be used. The present invention has been described using specific equations in order to facilitate understandings of the present invention, but unless specifically stated otherwise, these equations are simply illustrative, and any other appropriate equations may be used. Classification into each embodiment or each item is not essential in the present invention, and matters described in equal to or more than two embodiments or items may be combined and used as necessary. Also, a matter described in an embodiment or item may be applied to another matter described in another embodiment or item unless they are contradictory. The present invention is not limited to the above-mentioned embodiment and is intended to include various variations, modifications, alterations, substitutions and so on without departing from the spirit of the present invention.

The present application claims priority based on Japanese patent application No. 2010-191568, filed in the JPO on Aug. 27, 2010, and the entire contents of the Japanese patent application No. 2010-191568 are incorporated herein by reference.

The invention claimed is:

1. A reflectarray, comprising:

a substrate; and a plurality of array elements, each of which is formed on one of a plurality of areas into which a principal surface of the substrate is divided, wherein each array element includes a plurality of patches and a gap between the patches, and a gap between the patches in at least one of the plurality of array elements is different from a gap between the patches in another array element of the plurality of array elements.

2. The reflectarray as claimed in claim 1, wherein a shape of the gap is a comb-shape.

3. The reflectarray as claimed in claim 2, wherein, a height and/or a width of a finger of the comb-shape of the gap in at least one of the plurality of array elements is different from the gap of another array element of the plurality of array elements.

4. The reflectarray as claimed in claim 1, wherein at least one of a size of the gap, a shape of the gap, a length of the gap, a width of the gap and a ratio between the length and the width of the gap of at least one of the plurality of array elements is different from the gap of another array element of the plurality of array elements.

5. The reflectarray as claimed in claim 1, wherein external dimensions of the plurality of array elements are substantially the same.

6. The reflectarray as claimed in claim 1, further comprising:

a metal plate that is formed on a surface opposite to the principal surface and that functions as a reflector.

* * * * *